US005974759A

United States Patent [19]

Burger

[11] Patent Number: 5,974,759

[45] Date of Patent: Nov. 2, 1999

[54] LATTICEWORK BEAM FOR REINFORCING CAST WALLS OR CEILINGS

[76] Inventor: Wilhelm Burger, Burgstallweg 22, A-8605-Kapfenberg, Austria

[21] Appl. No.: 08/693,278

[22] PCT Filed: Feb. 9, 1995

[86] PCT No.: PCT/AT95/00028

§ 371 Date: Oct. 18, 1996

§ 102(e) Date: Oct. 18, 1996

[87] PCT Pub. No.: WO95/21973

PCT Pub. Date: Aug. 17, 1995

[30] Foreign Application Priority Data

Feb. 10, 1994 [AT] Austria ..... A 268/94

[51] Int. Cl.[6] ..... E04C 3/02

[52] U.S. Cl. ..... 52/695; 52/696; 411/508

[58] Field of Search ..... 52/731.1, 724.3, 52/730.4, 730.5, 731.3, 732.2, 690, 693, 694, 695, 696, 697; 411/508, 509

[56] References Cited

U.S. PATENT DOCUMENTS

| | | | |
|---|---|---|---|
| 1,865,059 | 6/1932 | Ragsdale . | |
| 2,136,071 | 11/1938 | Braden . | |
| 2,284,898 | 6/1942 | Hartman . | |
| 2,865,059 | 12/1958 | Scriven | 52/695 |
| 3,122,224 | 2/1964 | Blickensderfer . | |
| 4,739,543 | 4/1988 | Harris, Jr. | 411/508 X |

FOREIGN PATENT DOCUMENTS

| | | |
|---|---|---|
| 467993 | 4/1913 | France . |
| 1298673 | 8/1961 | France . |
| 1370057 | 7/1963 | France . |
| 2207543 | 11/1972 | France . |
| 331016 | 5/1974 | Germany . |

*Primary Examiner*—Creighton Smith
*Attorney, Agent, or Firm*—Herbert Dubno

[57] ABSTRACT

A reinforcement for a cast material for the fabrication of walls and ceilings of a structure which has two latticework beams interconnected by spaces using plastic plugs extending through aligned bores of the spacers and the longitudinal chords of the beams. The beams themselves have the longitudinal chords connected together by zig-zag strips and the longitudinal chords, zig-zag strips and spacers are all formed from galvanized sheet steel.

4 Claims, 2 Drawing Sheets

LATTICEWORK BEAM FOR REINFORCING CAST WALLS OR CEILINGS

CROSS REFERENCE TO RELATED APPLICATIONS

This application is a national stage of PCT/1895/00028 filed Feb. 9, 1995 and based, in turn, on Austrian National Application A 268/94 filed Feb. 10, 1994 under the International convention.

FIELD OF THE INVENTION

The invention relates to a latticework beam for reinforcing walls or ceilings made of cast material, consisting of two longitudinal chords with diagonal bars between them, whereby the diagonal bars consist of a sheet steel strip bent in a zig-zag shape, running through the latticework beam and which is connected at its bending points with the profiled longitudinal chords, also made of sheet steel strips.

BACKGROUND OF THE INVENTION

In a latticework beam known from German Patent 835 647, the continuous sheet steel strip of the diagonal bars runs so that the width of the strip is parallel to the plane of the latticework beam. It seems that the inventor considered this to be necessary, in order to achieve a connection between the longitudinal chords and the diagonal bars solely by clamping. Here the disadvantage is the lack of rigidity of the latticework beam in transverse direction, which is particularly noticeable during transport.

OBJECT OF THE INVENTION

It is the object of the invention to provide a latticework beam of the aforementioned kind, whose production is simple, but which still has a high degree of rigidity. Moreover with such latticework beams it should be possible to form a support framework in a simple manner.

SUMMARY OF THE INVENTION

This object is achieved in a steel latticework beam wherein that the width of the trough-shaped sheet steel strip forming the diagonal bars and the width of the longitudinal chords extend transversely to the longitudinal median plane of the latticework beam. In the area of junction points, the sheet steel strip of the diagonal bars has a segment running parallel to the longitudinal chords.

The sheet steel strip can be obtained by cutting galvanized steel sheets into strips and forming them accordingly. Since the zinc has the tendency to move to the cut edges, these cut edges are also protected against corrosion.

For the connection of the diagonal bars with the longitudinal chords, it has proven to be suitable to connect the throughgoing sheet steel strip of the diagonal bars with the longitudinal chords at junction points by compression.

A support framework of latticework beams according to the invention can also be formed in a simple way by providing the longitudinal chords with spaced-apart bores and by connecting at least two approximately parallel latticework beams with spacers also provided with bores, by means of connection elements placed in the bores, whereby the spacers consist of a galvanized sheet steel strip.

In order to simplify the production and storage, the sheet steel strips of the longitudinal chords and the spacers are of the same type.

The connection between the longitudinal chords and the spacers does not have to withstand great forces, it serves merely for securing the latticework beam placed in a mold, whereby subsequently a cast mass, particularly concrete or lightweight concrete, is poured into the mold. It is therefore possible that the connection elements be designed as plastic plugs equipped with an elastic tab having a projection, which resiliently engages and disengages when inserted into a bore. Such plastic plugs have only to be pressed into the bores to insure a firm connection between the longitudinal chords and the spacers.

The plastic plugs may also be used in a simple way to insure the secure embedding of the support framework in the cast mass. This simple step consists in that the plastic plugs project beyond the spacers on the side opposite to the tabs. Therefore due to the plastic plugs a space is forcibly maintained between the mold walls and the support framework.

BRIEF DESCRIPTION OF THE DRAWING

The above and other objects, features, and advantages will become more readily apparent from the following description, reference being made to the accompanying drawing in which.

SPECIFIC DESCRIPTION

Figure 2:
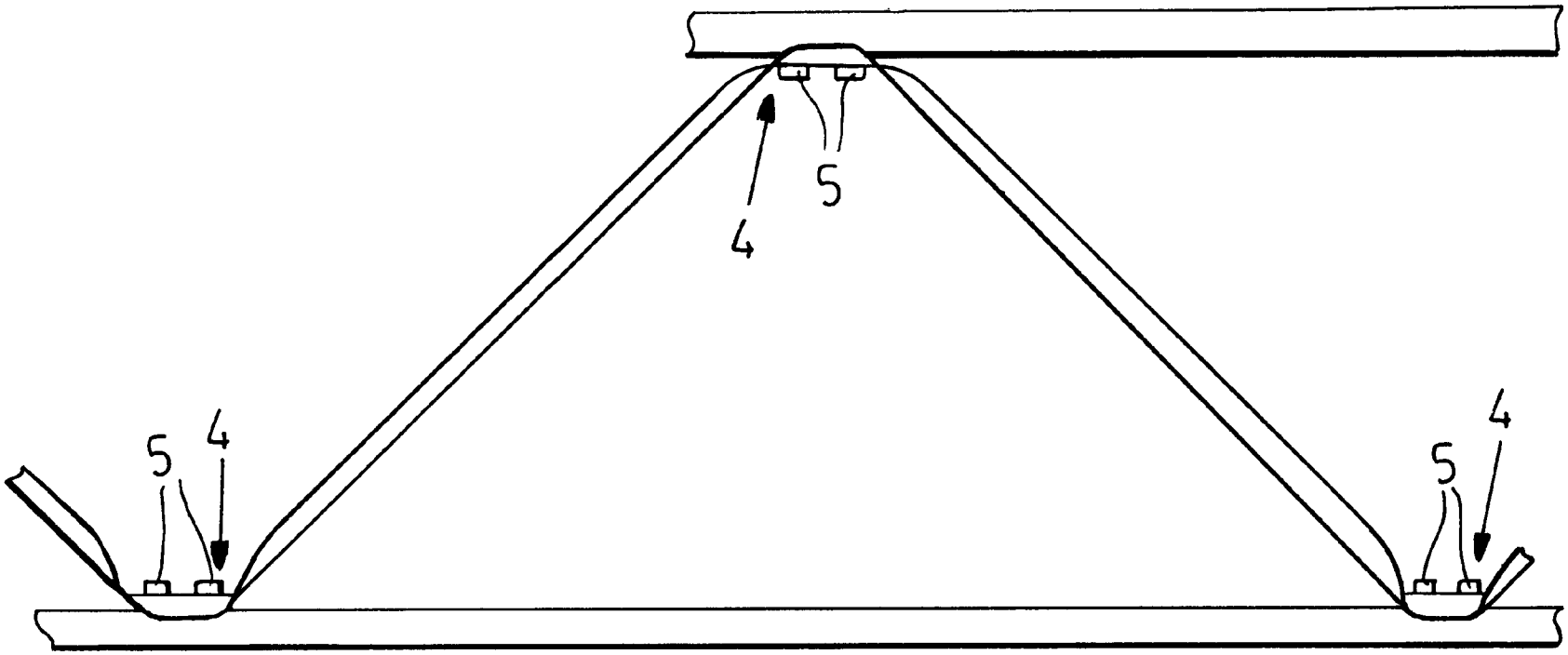
FIG. 2 is a side view of a latticework beam.

According to the drawing a latticework beam consists of two longitudinal chords 1 and 2 and diagonal bars 3 running between them. The longitudinal chords 1 and 2, as well as the diagonal bars 3, each consist of a galvanized sheet steel strip, which has a trough shape. The diagonal bars 3 are thereby slightly narrower than the longitudinal chords 1 and 2 and are formed by a continuous sheet steel strip, which is connected by compression with the longitudinal chords at the junction points 4. The dents formed during compression are marked with the numeral 5 in FIG. 2.

Figure 1:
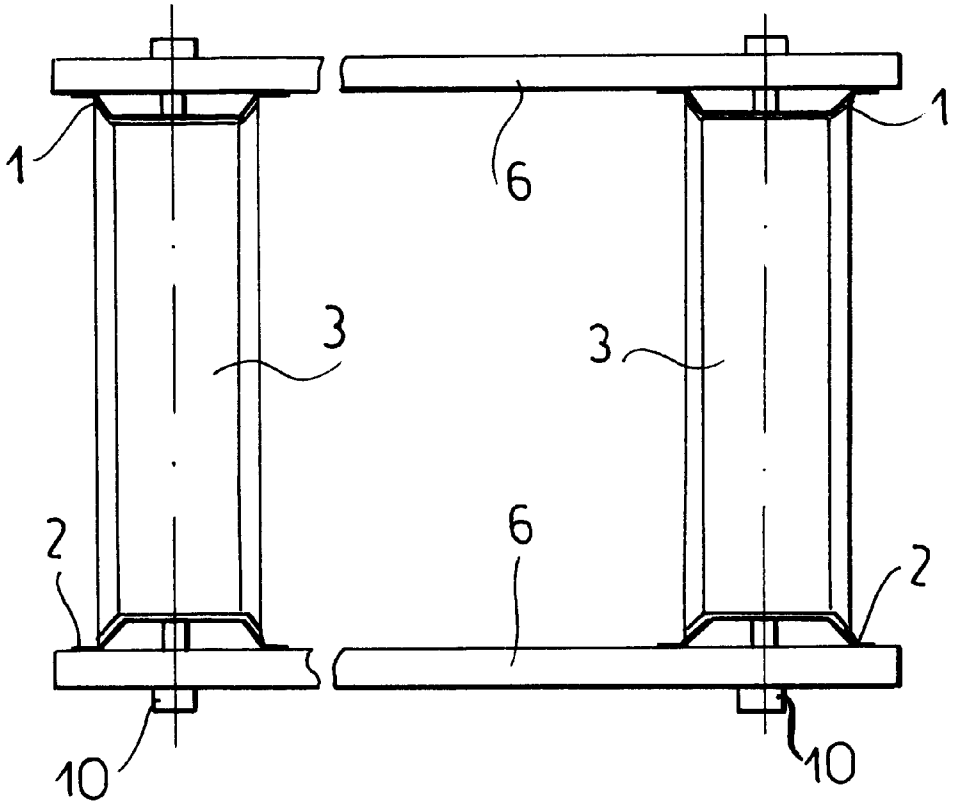
FIG. 1 is a cross sectional view of a support framework of latticework beams according to the invention.

As can be seen from FIG. 1, in the area of the junction points 4, the sheet steel strip of the diagonal bars 3 has segments running parallel to the longitudinal chords 1 and 2, at each the sheet steel strip and the longitudinal chords 1, 2 are pressed together.

According to FIG. 1 the longitudinal chords 1 of two mutually parallel running latticework beams are connected to each other by spacers 6. These spacers are made the same way as the longitudinal chords 1, e.g. they consist of a galvanized sheet steel strip and have the same shape and size as the longitudinal chords 1.

Figure 3:
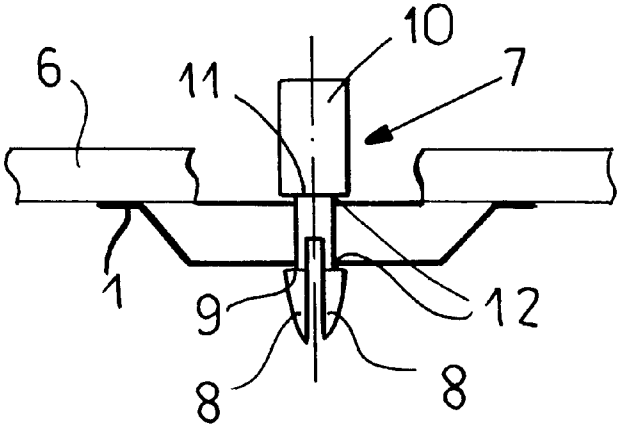
FIG. 3 shows on an enlarged scale a section through the junction point between a longitudinal chord and a spacer.

The connection between the longitudinal chords 1 with the spacers 6 shown in FIG. 3 is made by means of plastic plugs 7, which have resilient tabs 8. In the area of the resilient tabs 8 a projection or step 9 is provided and opposite to the tabs 8 extends a cylindrical part 10, which ends in a peripheral projection or step 11. The plastic plug 7 is slotted in the area of the tab 8.

The longitudinal chord 1, as well as the spacer 6, is provided with bores 12 traversed by the plastic plugs 7. When the plastic plug 7 is plugged into the bores 12, the tabs 8 are pressed against each other, so that the plastic plug 7 can be pushed through. After reaching the final position shown in FIG. 3, the tabs 8 spring back, so that the projection or step 9 lies against the longitudinal chord 1. The projection or step 11 lies against the spacer 6, so that a secure connection of the longitudinal chord 1 and the spacer 6 results.

Within the framework of the invention it is possible to make many changes. So for instance a kind of snap-button connection can also be used for the connection between the spacers 6 and the longitudinal chords 1, 2. The sheet steel strip can also have further, even different shapes, respectively canted profiles to increase stability.

I claim:

1. A reinforcement for a cast material for a structure, comprising:

two mutually parallel transversely spaced latticework beams, each of said beams including:

two longitudinal chords of galvanized chamfer-shaped channels of sheet steel strip, and diagonal bars between said longitudinal chords and formed by a galvanized chamfer-shaped channel of sheet steel strip in a zig-zag pattern connected at respective bends with said longitudinal chords, said longitudinal chords being formed with spaced apart bores therein;

transverse galvanized sheet steel spaces bridging the longitudinal chords of said beams and having bores aligned with the bores of the longitudinal chords bridged by the respective spacers; and plastic plugs connecting said spacers to the longitudinal chords of said beams, said plastic plugs having elastic tabs traversing aligned bores, and respective steps on said tabs for engagement and disengagement with said longitudinal chords.

2. The reinforcement defined in claim 1 wherein said plastic plugs project beyond said spacers at sides of said plugs opposite the tabs thereof.

3. The reinforcement defined in claim 2 wherein said bends are connected to said longitudinal chords by a pressed junction therebetween.

4. The reinforcement defined in claim 1 wherein said bends are connected to said longitudinal chords by a pressed junction therebetween.

* * * * *